United States Patent [19]

Wieck

[11] 4,004,375

[45] Jan. 25, 1977

[54] APPARATUS FOR CONTINUOUS CLEANING OF A HONING TOOL

[75] Inventor: Karl Wieck, Stuttgart, Germany

[73] Assignee: Supfina Maschinenfabrik Hentzen KG, Remscheid, Germany

[22] Filed: July 25, 1975

[21] Appl. No.: 600,882

[30] Foreign Application Priority Data

July 25, 1974 Germany ..... 2435848

[52] U.S. Cl. ..... 51/59 SS; 51/67; 51/103 TF; 51/262 A; 51/266; 51/289 R; 51/DIG. 2; 51/DIG. 11

[51] Int. Cl.[2] ..... B24B 7/00

[58] Field of Search ..... 51/59 R, 59 SS, 67, 51/262 A, 289 R, 266, DIG. 11, DIG. 2, 103 TF

[56] References Cited

UNITED STATES PATENTS

| | | | |
|---|---|---|---|
| 2,647,846 | 8/1953 | Bagno | 51/59 SS |
| 2,804,724 | 9/1957 | Thatcher | 51/59 SS |
| 3,345,783 | 10/1967 | Militzer | 51/59 R |
| 3,423,887 | 1/1969 | Strom et al. | 51/59 R |
| 3,713,987 | 1/1973 | Zow | 51/59 SS |
| 3,898,769 | 8/1975 | Makedonski et al. | 51/103 TF |

*Primary Examiner*—Harold D. Whitehead
*Assistant Examiner*—Robert C. Watson
*Attorney, Agent, or Firm*—Edwin E. Greigg

[57] ABSTRACT

The honing tool in a centerless honing apparatus is held in an oscillating head and is pressed against the workpiece transported by rotating rollers. The region of contact between the honing tool and the workpiece is immersed in a flushing liquid which serves to dislodge and remove abraded material from the contact surface of the honing tool. An ultrasonic generator is located near the honing tool and its transducer portion extends into the flushing liquid. The ultrasonic vibrations are transmitted by the flushing liquid to the honing tool, imparting thereto ultrasonic oscillations in a direction transverse to the rotational axis of the workpiece. The liquid also transmits ultrasonic vibrations directly to the contact area and to the embedded abraded material, thereby loosening it and permitting entrainment by the flushing liquid.

3 Claims, 1 Drawing Figure

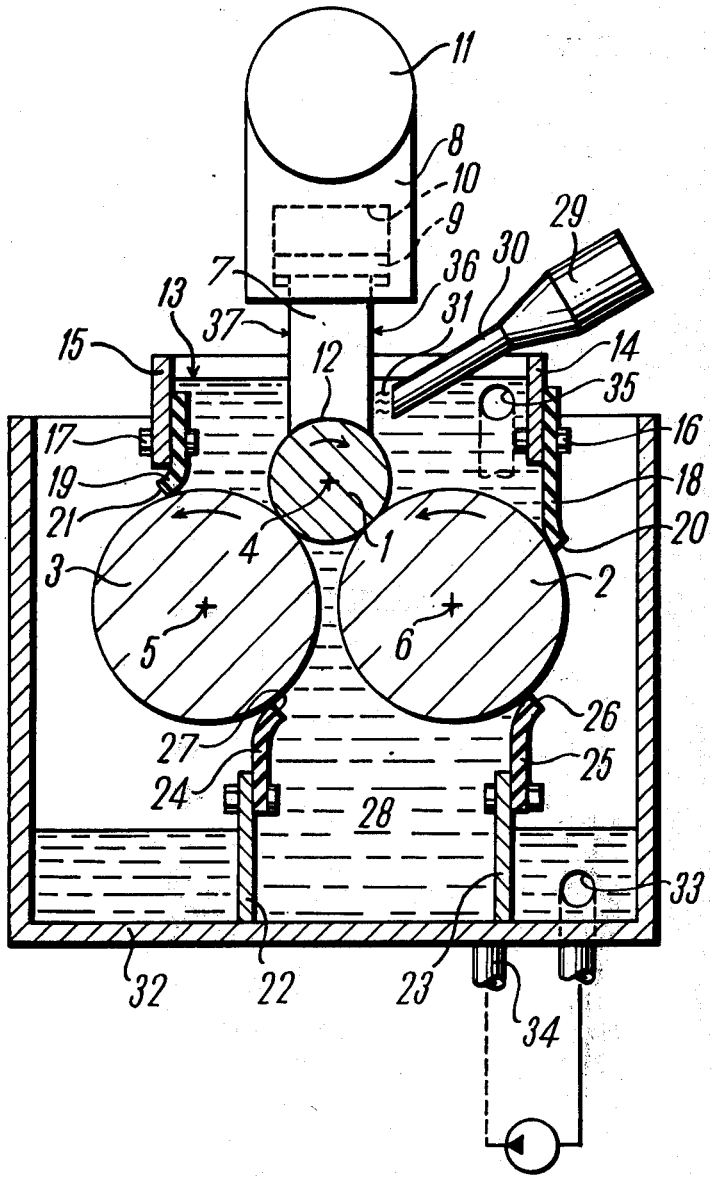
11
8
10
9
29
30
36
7
13
37
31
15
12
14
35
17
16
19
18
21
20
4
1
3
2
5
6
26
27
25
24
28
33
32
22
23
34

APPARATUS FOR CONTINUOUS CLEANING OF A HONING TOOL

BACKGROUND OF THE INVENTION

The invention relates to a method for the continuous cleaning of a honing tool during the operation of a honing machine. The honing tool rests on a rotating workpiece and executes swinging motions parallel to the rotational axis of the workpiece. During the grinding operation, a flushing liquid is applied to the area of contact between the tool and the workpiece. The invention further relates to an apparatus for carrying out the above method.

Such methods and apparatus are known, but they have the disadvantage that the working surface of the honing tool, i.e. that surface which makes contact with a workpiece, supported, for example, without centers on transport rollers, is clogged relatively rapidly with microscopically small fragments from the honing tool and from the workpiece. On the other hand, due to this clogging, any dulled grains of the honing tool can no longer break out of the binder material resulting in a relatively rapid dulling of the entire honing tool. On the other hand, even very minor causes, for example the slight shock due to the passage of edges of sequential workpieces under the honing tool, or a temporary loss of contact of the honing tool from the workpiece will often result in unpredictable, effective resharpening of the honing tool. This variation may result in different material removal rates from one workpiece to the next and thus to a widening of the tolerance limits of the process. Even when relatively large volumes of flushing liquid are used, this disadvantage is not cured, because the relatively large contact surface between the honing tool and the workpiece usually prevents the flushing liquid from reaching all areas of contact in sufficient quantities and with a sufficient intensity so as to remove clogged material everywhere.

OBJECT AND SUMMARY OF THE INVENTION

Accordingly, it is a principal object of the present invention to provide a process, and an apparatus for carrying out this process, which prevents a clogging of the contact surface of the honing tool due to the deposition of fragments of the honing tool itself and/or material removed from the workpiece, which might lead to a rapid decrease of the rate of material removal and which also might lead to uncontrollable widening of the tolerances of the process by unpredictable effective sharpening of the honing tool.

This object is attained, according to the invention, by imparting to the honing tool a high frequency oscillatory motion transverse with respect to the rotational axis of the workpiece and substantially confined to that end of the honing tool which makes contact with the workpiece.

An apparatus for carrying out this method provides that the workpiece and the interface area of the honing tool and the workpiece are all located within a container which is filled with a flushing liquid whose level is higher than the interface area and by providing an ultrasonic generator, located in the vicinity of the side walls of the honing tool, which directs ultrasonic waves to the contact area of the honing tool, the waves being transmitted by the flushing liquid.

The invention is based on the discovery that very small transverse oscillations, such as result from agitating the honing tool by ultrasonic waves, prevent clogging of the contact area of the honing tool with material fragments removed from the honing tool or from the workpiece. Preferably, the flushing liquid also serves as the medium for transmitting the ultrasonic vibrations.

The method according to the invention has special significance when used with honing machines that have a very rigid or stiff machine frame in which incidental transverse oscillations, such as might occur in older machines due to their greater free play, would not be sustained.

The invention will be better understood and further objects and advantages will become more apparent from the ensuing detailed specification of a preferred, but merely exemplary, embodiment taken in conjunction with the drawing.

BRIEF DESCRIPTION OF THE DRAWING

The single FIGURE of the drawing is a cross-sectional view of an exemplary embodiment of the invention.

DESCRIPTION OF THE PREFERRED EMBODIMENT

Turning now to the drawing, there is shown a cylindrical workpiece 1, for example a bolt, a piston wrist pin or even a needle of a needle bearing which is held between two transport rollers 2 and 3 that are arranged to rotate in the same direction. The rotation of the transport rollers 2 and 3 imparts to the workpiece 1 a centerless rotation. The transport of the workpiece 1 in the direction parallel to its own rotational axis, i.e. perpendicular to the plane of the figure, is due to the mutual inclination of the rotational axes 5 and 6 of transport rollers 2 and 3, respectively. Thus, in addition to the rotation, the workpiece 1 also has a motion component in the direction of the axis 4.

Riding on the workpiece 1 is a honing tool 7 which is pressed against the rotating workpiece 1 with a predetermined amount of pressure. The honing tool 7 is held in a honing tool holder 8 which includes a suitable mechanism, for example a cylinder 10 and a piston 9 which, together, urge the honing tool against the rotating workpiece 1. An oscillating head 11 serves to impart to the honing tool holder 8 and to the honing tool 7 an oscillatory motion of a few millimeters amplitude in a plane parallel to the rotational axis 4. The oscillating head 11 and the honing tool holder 8 are fastened on a machine frame (not shown). An oscillating head 11 which may be suitably employed is described in U.S. Pat. No. 2,716,392.

The honing process described above is a so-called super-finishing process, i.e. the exterior surfaces of cylindrical workpieces are continuously ground and honed in a centerless manner.

The contact area between the honing tool 7 and the rotating workpiece 1 is suffused with a flushing liquid, for example honing oil, a petroleum derivative, suitable mixtures of oils or other suitable fluids. However, as has been mentioned previously, it is difficult to keep the whole interface contact area 12 between the honing tool 7 and the cylindrical workpiece 1 clean continuously. The honing tool 7, which comprises abrasive grains held in a binding material, and which causes the removal of material from the cylindrical workpiece 1, is itself subject to a certain amount of wear. This wear is manifested in that the abrasive grains held in the binding material become dull and are broken out of the binding material, possibly taking with them some of the binding material. During the honing process, the contact surface 12 of the honing tool 7 conforms very precisely to the cylindrical outer surface of the workpiece 1. The material removed from the honing tool 7, as well as the material removed by the honing tool from the workpiece 1 is in the form of an extremely fine powder which has the tendency to contaminate or clog the contact surface of the honing tool, i.e. to make it dull. Even when flushing liquids are used in known manner, these powdered materials are not entirely carried away from the contact area 12 by the rotating workpiece due to the exact mating of the contact area 12 and the outer surface of the workpiece 1. As a result, the powdered material remains attached to the contact surface 12, of the honing tool especially in voids between the individual abrasive grains, so that the dulled abrasive grains can no longer break out of the binding material. Accordingly, the rate of material removal from the workpiece 1 decreases. This deterioration occurs very rapidly; it can become noticeable after the processing of a few dozen workpieces.

On the other hand, to make matters even worse, the slightest grinding irregularity may cause an effective resharpening of the honing tool, i.e. a king of "dressing", which leads to a renewed and increased material removal from the workpiece. This irregularity may be due, for example, to the abrupt transition from one workpiece to another when two endwise adjacent workpieces pass underneath the honing tool. The protruding edge of a workpiece entering beneath the honing tool 7 leads to the above mentioned dressing and thus causes a newly increased material removal rate. Thus, when several workpieces are processed, the final dimensions are subject to considerable variations leading to wide machining tolerances, which it is the purpose of fine machining to prevent. The same effect can occur when the honing tool is lifted from the work temporarily and then makes renewed contact with the work. The soiling, i.e. clogging which is the cause of these fluctuations in the final dimensions of the work can not be eliminated even by an intensive flushing with flushing liquid due to the very tight fit and the large area of contact between the contact surface 12 and the outer surface of the workpiece 1. The exemplary embodiment shown in the figure provides that the contact surface 12 which engages the workpiece 1 lies below the level 13 of the flushing liquid. This purpose is achieved by providing a container substantially parallel to the longitudinal extent of the transport rollers; this container is formed by lateral plates 14 and 15 to which are attached flexible side members 18 and 19, for example with the aid of fastening screws 16 and 17. The side members 18,19 may be made of rubber or flexible plastic and as shown, their lower edges 20,21 are in wiping contact with the outer surfaces of the rollers 5 and 6. The lower part of the container is formed by plates 22 and 23 which also have flexible side members 24,25 whose upper edges 26,27 make wiping contact with the circumference of the transport rollers 5,6. The ends of the container (not shown in the figure) are formed by additional flexible members, for example by elastic foils, etc., thereby creating a container whose volume is defined by the members 18,19,24,25, as well as by the side plates 14,15,22,23 and which is filled with flushing liquid 28 up to the level 13.

Mounted on the top of the container and partially extending below the level 13 of the flushing liquid 28 is an ultrasonic generator 29. Its transmission head 30, which lies below the level 13, directs ultrasonic waves in the direction of the honing tool 7 as is indicated by the wavy lines 31. These ultrasonic waves impart a high frequency oscillation to the honing tool, corresponding to the ultrasonic frequency, which occurs transversely to the longitudinal axis of the workpiece 1, i.e. transversely to the swinging oscillation provided by the oscillator head 11. This extremely low amplitude oscillation at ultrasonic frequency loosens the powdered material removed from the honing tool or from the workpiece which adheres to the contact surface 12. This loosening enhances the entrainment and removal of this material by the flushing liquid. The flushing liquid 28 thus transmits the ultrasonic oscillations from the transmitter head 30 of the ultrasonic generator 29 to the honing tool 7, and also directly to the clogging matter adhering to the contact surface 12.

The ultrasonic oscillation of the honing tool 7 takes place transversely to its main, swinging oscillation, which is parallel to the rotational axis of the workpiece. The ultrasonic oscillations may have a relatively high frequency, for instance, approximately 20,000 Hz, and an extremely small amplitude (a few 100ths of a millimeter). This oscillation becomes fully developed only in the vicinity of the end of the honing tool nearest the contact surface 12, so that any feedback effects on the other machine members, especially on the honing tool holder or the machine frame are negligibly small.

The container which is formed by the side plates 14,15, 22,23 and by the flexible side members 18,19,24,25, as well as by appropriate end plates and flexible end members contains the flushing liquid 28 up to a level 13. This container is surrounded by a further, outer container 32 which collects any flushing liquid which penetrates through the opening between the transport rollers 2,3 and the flexible side members 18,19, 24,25. This leakage liquid is pumped back to the inner container through a drain 33, possibly through a filter (not shown), and a line 34, terminating at an inlet 35 of the outer container which holds liquid up to the level 13. The ultrasonic generator 29,30 is so embodied that there is a substantially uniform transmission of ultrasonic energy to the lateral surfaces 36,37 of the honing tool 7. If necessary, several ultrasonic generators may be provided and, if required, they may be located on both sides of the honing tool 7.

In a variant embodiment of the invention, the plates 22,23 and the side members 24,25 fastened thereto may be omitted because, when completely cylindrical parts, such as, for example wrist pins, are being processed, very little liquid passes between workpiece 1 and the transport rollers 2,3. In that case, it is sufficient to provide flexible members at the ends of the transport rollers. Under this condition, the container described above is then formed only by the elements designated 14,15,18 and 19. In that instance, it is possible also to dispense with pumping back leaked flushing liquid and it is only necessary to compensate for the loss of flushing liquid through the opening 35. Any other suitable method for maintaining the level 13 may be employed.

What is claimed is:

1. In a device for superfinishing a cylindrical workpiece including means for holding and supporting said workpiece and including a honing tool which contacts a cylindrical surface of said workpiece with its working surface under a predetermined pressure and including reciprocating driving means for imparting to said honing tool a reciprocating motion in a direction parallel to the axis of rotation of the workpiece, and further including ultrasonic driving means with a transmitter head for imparting an oscillatory motion to the honing tool in a direction perpendicular to the first mentioned reciprocating motion, the improvement comprising:

container means surrounding the workpiece and the workpiece-contacting surface of the honing tool, said container means being filled with a liquid, the transmitting head of said ultrasonic driving means being immersed below the surface of said liquid; whereby said liquid serves as a medium for transmitting ultrasonic vibrations to the workpiece-contacting surface of the honing stone.

2. A device according to claim 1, wherein said means for holding and supporting are two rotating transport rollers, disposed with their axes of rotation in non-parallel configuration, and wherein said container means includes flexible portions which are in wiping contact with said transport rollers to provide a sealing action therewith.

3. A device according to claim 2, wherein said container means includes means for admitting and removing flushing liquid to and from said container means and is capable of compensating for quantities of flushing liquid leaking through the seal formed by said flexible portions of said container means with the surfaces of said transport rollers, during the operation of said device.

* * * * *